US007052209B1

(12) United States Patent
Kruger et al.

(10) Patent No.: US 7,052,209 B1
(45) Date of Patent: May 30, 2006

(54) CORRUGATED STORMWATER CHAMBER

(75) Inventors: Kurt J. Kruger, Hamden, CT (US); Jonathan F. Smith, Waterford, CT (US); Bryan F. Coppes, Old Saybrook, CT (US); Raymond Connors, East Haddam, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 10/402,414

(22) Filed: Mar. 28, 2003

Related U.S. Application Data

(63) Continuation-in-part of application No. 09/849,768, filed on May 4, 2001.

(60) Provisional application No. 60/368,764, filed on Mar. 29, 2002, provisional application No. 60/202,255, filed on May 5, 2000.

(51) Int. Cl.
*E01F 5/00* (2006.01)

(52) U.S. Cl. ..... 405/125; 405/126; 405/39

(58) Field of Classification Search ..... 405/124–127, 405/43–49, 39
See application file for complete search history.

(56) References Cited

U.S. PATENT DOCUMENTS

| | | | | | |
|---|---|---|---|---|---|
| 460,352 | A * | 9/1891 | Reading | 405/48 |
| 680,548 | A * | 8/1901 | Sikes | 405/46 |
| 980,442 | A * | 1/1911 | Schlafly | 405/48 |
| 1,541,918 | A * | 6/1925 | Brennan | 405/48 |
| 1,989,950 | A * | 2/1935 | Snyder | 138/173 |
| 2,866,319 | A * | 12/1958 | Nicholson | 405/46 |
| 3,495,410 | A * | 2/1970 | Bailey et al. | 405/46 |
| 3,570,251 | A * | 3/1971 | Roberts | 405/46 |
| 4,245,924 | A * | 1/1981 | Fouss et al. | 405/45 |
| 4,598,277 | A * | 7/1986 | Feldman | 340/604 |
| 4,605,338 | A * | 8/1986 | Peterson | 405/124 |
| 4,759,661 | A * | 7/1988 | Nichols et al. | 405/48 |
| 4,838,317 | A * | 6/1989 | Andre et al. | 138/135 |
| 5,156,488 | A * | 10/1992 | Nichols | 405/48 |
| 5,441,363 | A * | 8/1995 | Gray | 405/49 |
| 5,833,394 | A * | 11/1998 | McCavour | 405/126 |
| 5,839,844 | A | 11/1998 | Nichols et al. | 405/43 |
| 6,050,746 | A * | 4/2000 | McCavour et al. | 405/124 |
| 6,076,993 | A * | 6/2000 | Gray | 405/43 |

(Continued)

OTHER PUBLICATIONS

Reln Plastics Pty. Ltd "The Original Reln Drain Trenching" 2-Page Brochure, date unknown.

*Primary Examiner*—Robert E. Pezzuto
*Assistant Examiner*—Alexandra Pechhold
(74) *Attorney, Agent, or Firm*—C Nessler

(57) ABSTRACT

An arch shape cross section chamber for receiving and dispersing stormwater when buried beneath the surface of the earth is corrugated and has a cross section geometry which is a continuous curve. Preferably, the curve is a truncated semi-ellipse. A chamber also has a combination of a standard corrugations along most of the length, in combination with smaller end corrugation with standard corrugations, to enable joining of chambers in overlap fashion, as a string; corrugations which have elliptically curved corrugation widths when viewed from the side of the chamber; and, sidewall base flanges which have turned up outer edges in combination with fins which connect said edges with the curved chamber sidewall. A domed end cap is adapted to both close the end of the chamber and to be positioned within the chamber length to provide a baffle.

6 Claims, 3 Drawing Sheets

U.S. PATENT DOCUMENTS 6,129,482 A * 10/2000 Ditullio ..... 405/43
6,203,245 B1 * 3/2001 Harten ..... 405/125
6,270,287 B1 * 8/2001 Gray ..... 405/100
6,361,248 B1 * 3/2002 Maestro ..... 405/49
6,595,722 B1 * 7/2003 McCavour ..... 405/126
6,612,777 B1 * 9/2003 Maestro ..... 405/49
6,698,975 B1 * 3/2004 Benecke ..... 405/43
2002/0067952 A1 6/2002 Cregcenzi et al. ..... 405/36

* cited by examiner

CORRUGATED STORMWATER CHAMBER

This application is a continuation in part of patent application U.S. patent Ser. No. 09/849,768 of Krueger et al., filed May 4, 2001. This application claims benefit of provisional patent application Ser. No. 60/202,255, filed May 5, 2000 and of provisional patent application Ser. No. 60/368,764 filed Mar. 29, 2002.

TECHNICAL FIELD

The present invention relates to molded non-metal chambers for subsurface receipt and dispersal of waters, in particular to molded plastic chambers for receiving stormwater.

BACKGROUND

In use, a storm water chamber is buried beneath the surface of the earth, to collect storm water, such as runoff from parking lots and the like. In a typical stormwater chamber installation, a multiplicity of chambers is laid into cavities in the earth as large array, and then covered over with gravel, stone or soil. See U.S. Pat. Nos. 5,156,488, 5,511,903 and 5,890,838 for examples of chambers. Often the chambers are placed on and buried in gravel; and overlaid with more gravel or soil or a paved surface for motor vehicle traffic or parking. Thus, it is important that they be structurally sound.

SUMMARY

An object of the invention is to provide stormwater chambers and related components which are strong, economic to produce, which nest well for shipping, which connect together well, and which are adapted for receiving internal flow control baffles.

In accord with the invention, an arch shape cross section chamber for receiving and dispersing stormwater when buried beneath the surface of the earth is corrugated and has a cross section geometry which is a continuous curve. Preferably, the curve is a truncated semi-ellipse, that is, less than half an ellipse, wherein the major axis of the ellipse lies along the vertical axis of the chamber. Thus, the vertical height of the chamber interior is less than half of the length of the major axis of the semi-ellipse of which the chamber geometry is a portion.

In accord with the invention, a storm water chamber comprises a combination of standard corrugations along most of the length, in combination with smaller end corrugations, to enable joining of chambers in overlap fashion, as a string; corrugations which have elliptically curved corrugation widths when viewed from the side of the chamber; and, sidewall base flanges which have turned up outer edges in combination with fins which connect said edges with the curved chamber sidewall.

In further accord with the invention, a domed end cap fits onto the end of the chamber to prevent gravel and soil form entering. A hole may be cut in the cap, so an input pipe can deliver water to the chamber. The cap and chamber are also shaped so the outer edge of the cap fits within the corrugations in the central part of the chamber, which corrugations are larger than those at one end. When so positioned, and when the dome has a cut out at an elevation substantially above the elevation of the base, water flow from one part of the chamber, or from one part of a series of interconnected chambers to another part, is inhibited.

The foregoing and other objects, features and advantages of the invention will become more apparent from the following description of preferred embodiments and accompanying drawings.

DESCRIPTION

An arch shape cross section chamber of the present invention is described in pending U.S. patent Ser. No. 09/849,768 of Krueger et al., filed May 24, 2001. The disclosure and drawings thereof are hereby incorporated by reference. The present invention is also described in two provisional patent applications, namely Ser. No. 60/202,255, filed May 5, 2000, and Ser. No. 60/368,764 filed Mar. 29, 2003, the disclosures of which are hereby incorporated by reference.

In the incorporated references, the invention is variously referred to as a storm management system and, in part, as a corrugated stormwater chamber. A typical chamber may be 45–50 inch wide at the base by 30 inch high at the peak interior and 91 inch long. It is preferably made of injection molded high density polypropylene, or polyethylene or comparable material.

Preferably it is made by injection molding, for precision, although other known methods of fabrication may alternatively be used.

Figure 1:
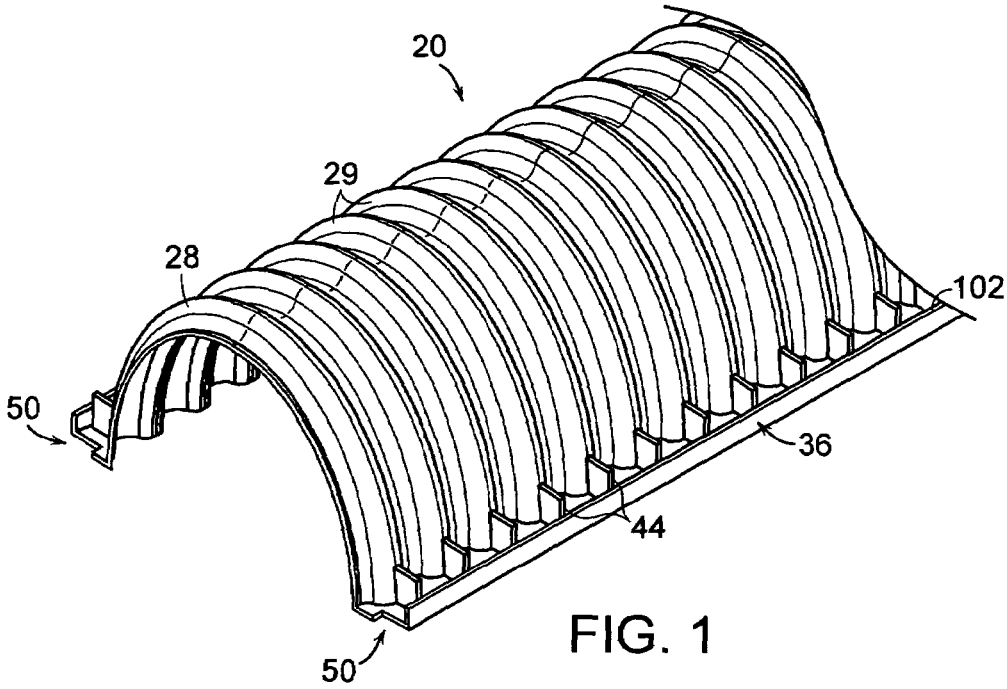
FIG. 1 is a partial isometric view of a molded plastic chamber.
Figure 2:
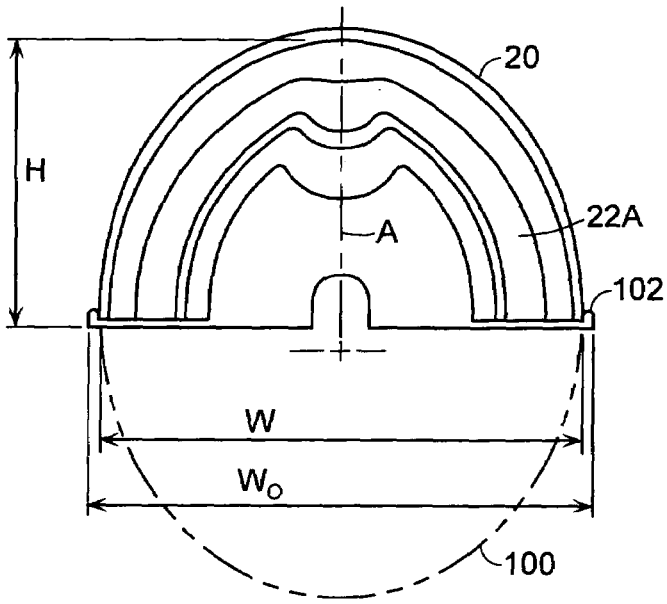
FIG. 2 is an end view of a chamber like that in FIG. 1, with an end plate attached at the end.

FIG. 1 shows a molded plastic chamber 20 having a continuous an arch shape cross section and corrugations 24 running along the arch shape from opposing side base flanges 36. Preferably, the chamber has a continuous curve cross section geometry, for strength. More particularly, the chamber has a cross section geometry which is a truncated semi-ellipse, as illustrated by FIG. 2 (which shows an end plate 22A in place, which is discussed below). The geometry is less than half an ellipse 100, the major axis A of which lies along the vertical axis of the chamber. Thus, the vertical height is less than half of the length of the major axis of the semi-ellipse. As shown in FIG. 2, the chamber has an inner height H and an inner width W. Preferably, the chamber has a width to height ratio (W/H) between about 0.5 to 1 and 2 to 1, more preferably between 1 to 1 and 2 to 1. Preferably, the height H is between about 44 and 48 percent of the length of the major axis of the ellipse of which the truncated semi-ellipse is a portion.

Figure 3:
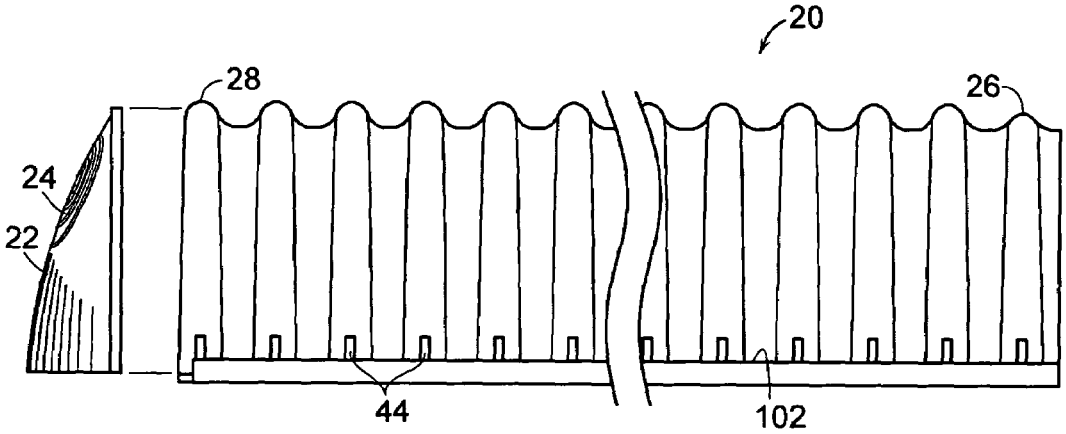
FIG. 3 is a side elevation view of a chamber with an end dome at one end.

The bulk of the body of the chamber has corrugations of a standard dimension, including first end corrugation 28, except for at least a smaller second end corrugation 26. See FIG. 3. The difference in dimension between corrugation 26 and the "standard" corrugation is roughly equal or greater than the wall thickness of the chamber at the corrugations, which thickness will be typically in the range 0.150–0.188 inch for an injection molded chamber.

Figure 4:
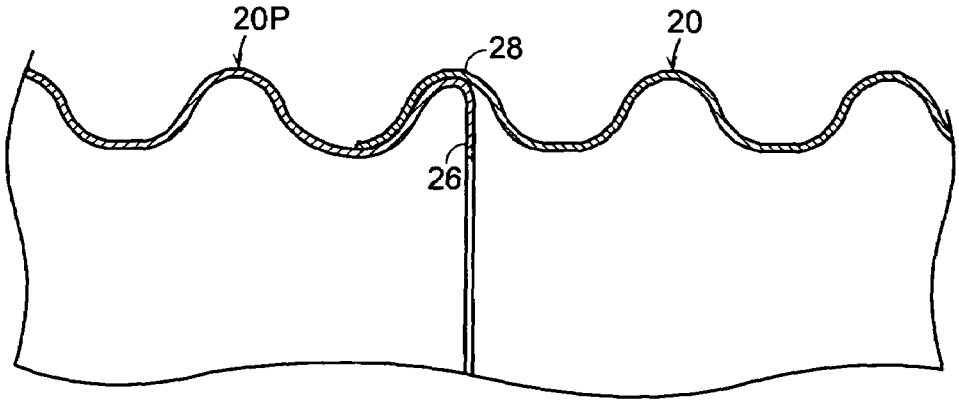
FIG. 4 is a fragmentary cross section of the joint formed between two mated chambers.

Thus, as shown in the partial vertical center-plane cross section of FIG. 4, the first end of a first chamber 20 can be laid on top of the second end of a second chamber 20P, so the chambers may thereby be joined together in the form a string of chambers. If a shorter chamber length is desired, as when a factory-made chamber is too long for the application, the chamber may be cut, for instance, at the midpoint in a valley. Thus the corrugation which is at the newly cut end of the chamber can be engaged with the smaller corrugation 26 at the second end of another chamber, overlapping it, to form a joint.

Figure 5:
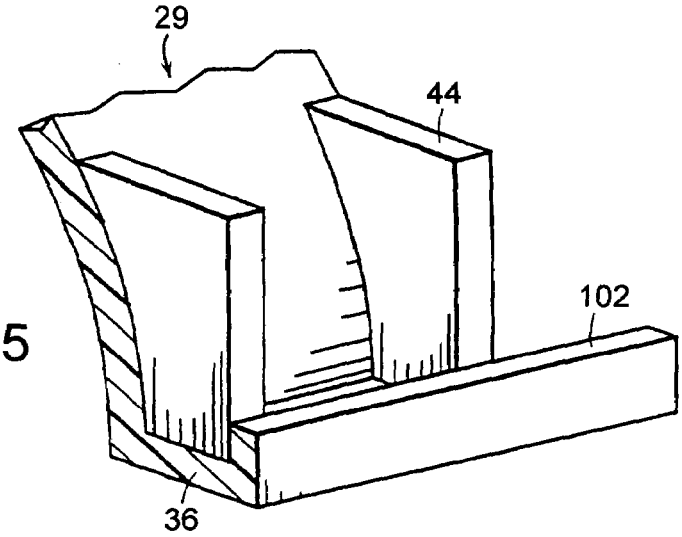
FIG. 5 is a fragmentary isometric view of the end of the chamber of FIG. 1, to illustrate details at the base of the chamber sidewall.

The opposing side flanges 36 have turned up outer edges 102, called support members, for providing strength in the longitudinal direction. See FIG. 5. The flanges 36 have cutout portions 50 at one end, where the large corrugation 28 is. See FIG. 1. Thus, when chambers are overlapped to form a string, the flanges 36 of the small end fit within the cutouts, and the chambers better fit together, than would be the case without the cutouts.

Figure 6:
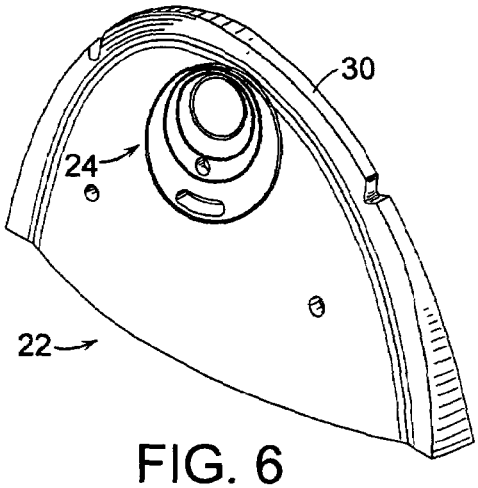
FIG. 6 is an isometric view of an end plate, referred to as and end dome.
Figure 7:
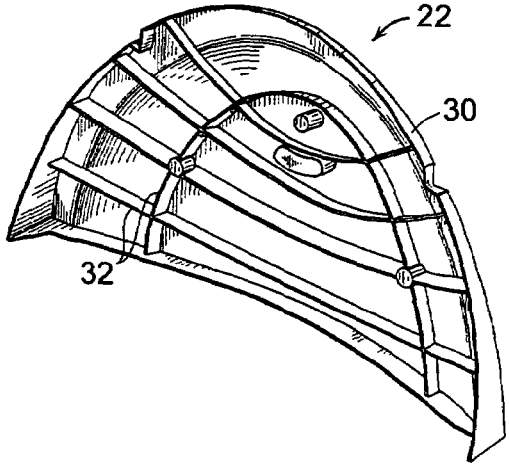
FIG. 7 is an isometric view of the interior of the end plate of FIG. 6.

An end plate 22, called an end dome here, is shown in FIGS. 6 and 7. How it engages and closes the open end of a chamber is shown in the side elevation view of FIG. 3. The end dome 22 has a dished or convex shape (viewed from the exterior of the chamber, when installed). Compared to the essentially flat end plates of the prior art, the end dome 22 has improved resistance to the load of encompassing compactable media such as crushed stone or soil which impinges on the dome when the chamber is buried and in use. The dished shape also provides more volume to the interior of a chamber than does a flat end.

FIG. 7 shows how the interior of the dome has a cross hatch ribbing 32, to provide further strength to the dished portion. The arch shape flange 30 of the end dome has an outer dimension which is less than or equal to the outside dimension of a smaller corrugation 26 of the chamber. Thus, the flange 30 slips within corrugation 28 at the first end of the chamber 24, just as does the smaller corrugation 26 of another chamber. Preferably, the fit of flange 30 at end corrugation 28 is intentionally looser than the fit of the smaller corrugation 26, to the extent that the flange will also fit within the smaller opposing end corrugation 26 of a chamber. Thus only one design end dome is needed for closing both ends of chamber 20, with its differing dimension end corrugations. In the generality of the invention, the end dome described here can be used on other kinds of chambers.

The end dome 20 can also fit within any of the other corrugations of the chamber 20, along the chamber length. Thus, if the chamber 20 is cut at any point along its length, to form a shortened length chamber, the end dome can be used as a closure at the cut end. The dome 22 has scoring which enable circular cutouts 24, to enable a pipe to deliver water to the interior of chamber(s).

When soil pushes on the dome end plate 22, there is a lateral outward force, as the dome tries to flatten. So, the loose fit referred to above is not so loose as to prevent the dome flange or periphery from engaging the inside of a chamber corrugation and pushing outwardly on it. Since the chamber is backed by soil or stone lying along the length of the chamber, the chamber in vicinity of said corrugation resists the outward force. Thus, the dome endplate in the invention provides substantially greater strength and stiffness than does a flat end plate.

An extra dome 22 with a through hole can be positioned at any point along the length of the chamber, to provide a baffle or act as a weir. In such use the dome may have a cutout at an elevation. Because of the kind of fit mentioned above, there can be flow through the gap between the end dome and chamber corrugation, so the end dome acts as a weir. If it is desired to prevent such, appropriate sealant or gasketing can be employed. Using a dome-as-weir creates subchambers within the length of a chamber. More than one dome may be positioned along the length of a chamber to create a multiplicity of subchambers. The dome-as-weir is used to make the subchamber function as a reservoir and settlement basin. Thus, water flowing along the length of the chamber will stagnate in velocity and desirable settling of entrained debris will be realized. Thus, by strategic placement of dome-weirs along the length of the chamber near the inlet end of a string of chambers, a preferential region for settlement of heavier than water debris is created. Cleaning is made easier. While the dome shaped end plate is preferred when a weir is desired, in the generality of this aspect of the invention, flat end plates may be used as weirs.

Figure 8:
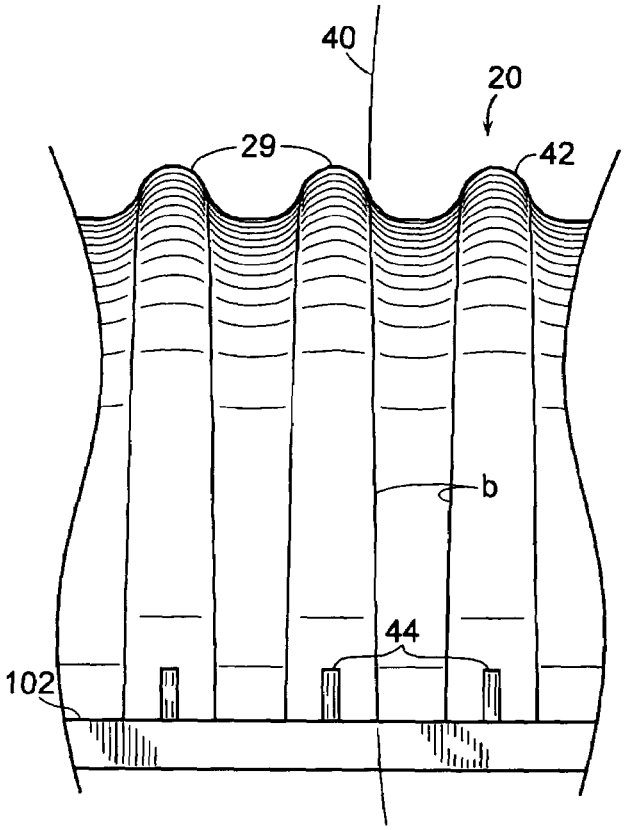
FIG. 8 is a side elevation view of a portion of a chamber, to illustrate corrugation contour.

The chamber has another feature which is characterized by an approximate or exact elliptical curve. This is appreciated when the chamber length is viewed from the side in elevation, as in FIG. 8. The edge b of each peak corrugation 28, 26, shown in somewhat exaggerated fashion in FIG. 8, is contoured as a segment of an imaginary second ellipse 40. The shape, and location in space relative to the chamber, of the second ellipse is selected so the corrugation tapers inwardly in side view, running toward the top 42 of the peak corrugation, as shown in the Figure. When chambers are stacked, the elliptical curve shape enables better nesting of the chambers than does a corrugation which has either no taper, or which has straightline or planar taper, both referenced to the vertical cross sectional plane. The straightline taper, used in some prior art devices, either will not provide sufficient nestability, or will result in a corrugation width at the top becoming near zero, which is not good for strength.

In another aspect of the invention, the chamber has vertical standoffs in the form of fins 44, also called connecting elements, which are spaced apart along the opposing side base flanges 36. Fins 44 connect outer edges 102 with the nearby curved chamber sidewall, to provide support to the flanges in the direction normal to the length of the chamber. See FIG. 5 and FIG. 1. The height of the fins is chosen to prevent the chambers from jamming one onto the other.

The inventions may be applied to chambers that have configurations other than the exemplary chambers; and, they may be applied to chambers used for other purposes than receiving and dispersing stormwater. For instance, the inventions may be applied to wastewater leaching chambers and to other arch like devices adapted for dispersing or gathering waters into or from soil and granular media.

Although this invention has been shown and described with respect to a preferred embodiment, it will be understood by those skilled in this art that various changes in form and detail thereof may be made without departing from the spirit and scope of the claimed invention.

We claim:

1. An apparatus combination which comprises:

an arch shape cross section thermoplastic chamber, for receiving or dispersing water when buried within water-permeable media, comprising a plurality of substantially identical alternating peak and valley corrugations, an open bottom, and an arch shape cross section geometry; wherein, at least one peak corrugation at a first end of the chamber is smaller than said plurality of corrugations, so that the opposing end of a like chamber may overlap the smaller corrugation, to thereby connect and form a joint between the chambers; and, a domed endplate, for fitting within the interior of said first end smaller peak corrugation, for closing off the first end of the chamber, to inhibit passage of media in which the chamber is buried;

wherein, the size and shape relationships among the endplate, the first end smaller peak corrugation, and the peak corrugation plurality is such that the end plate may alternatively be positioned within the interior of a peak of said plurality of corrugations, to inhibit passage of media or water.

2. The apparatus of claim 1 wherein the geometry of the arch shape cross section is a continuous curve.

3. The apparatus combination which comprises:

(a) multiplicity of identical thermoplastic chambers, for receiving or dispersing water when buried within water-permeable media, interconnected in serial fashion to form a string of chambers, wherein each chamber has an arch shape cross section, a plurality of substantially identical alternating peak and valley corrugations, an open bottom, and an arch shape cross section geometry which is a continuous curve, each chamber having at least one peak corrugation at a first end of the chamber which is smaller than said plurality of corrugations, so that the opposing end of a like chamber having one or more of said plurality of corrugations can overlap the smaller corrugation, to form a joint between the chambers;

(b) a first endplate, for fitting within the interior of said first end smaller peak corrugation, for closing off the first end of a chamber, to inhibit passage of media or water;

wherein, the size and shape relationships among the endplate, the first end smaller peak corrugation, and said plurality of corrugations is such that the end plate may alternatively be positioned within either said first end smaller peak corrugation or within the interior of a peak of said plurality of corrugations, to inhibit passage of media or water; and, (c) a second endplate, identical to said first end plate in size and shape relative to a chamber, positioned with the interior of one peak corrugation which comprises said plurality, at a location spaced part from said first endplate along the length of said string of chambers, to thereby inhibit the passage of media or water within or into said string.

4. The apparatus of claim 3, wherein one of said multiplicity of chambers has been shortened by cutting, and wherein the second endplate closes off the cut end of the shortened chamber and thereby the end of the said string of chambers.

5. The apparatus of claim 3 wherein said second endplate is positioned along the length of the string and has a hole for passage of water, so that the endplate provides a weir for water which flows within the chamber string.

6. The apparatus of claim 3 wherein each endplate has a dome shape.

* * * * *